US006695052B2

(12) United States Patent
Branstetter et al.

(10) Patent No.: US 6,695,052 B2
(45) Date of Patent: Feb. 24, 2004

(54) TECHNIQUE FOR SENSING FLOW RELATED PARAMETERS WHEN USING AN ELECTRIC SUBMERSIBLE PUMPING SYSTEM TO PRODUCE A DESIRED FLUID

(75) Inventors: Todd M. Branstetter, Nowata, OK (US); Kevin T. Scarsdale, Bartlesville, OK (US); Lee S. Kobylinski, Bartlesville, OK (US); Nolan D. Wanner, Pecatonica, IL (US); John Pursell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 19 days.

(21) Appl. No.: 10/041,514

(22) Filed: Jan. 8, 2002

(65) Prior Publication Data

US 2003/0127223 A1 Jul. 10, 2003

(51) Int. Cl.[7] ..... E21B 47/06

(52) U.S. Cl. ..... 166/250.15; 166/66.4; 166/105; 166/250.07

(58) Field of Search ..... 166/65.1, 66.4, 166/68, 105, 106, 369, 250.01, 250.15, 250.07

(56) References Cited

U.S. PATENT DOCUMENTS

| | | | | |
|---|---|---|---|---|
| 5,211,225 A | | 5/1993 | Grosch | |
| 5,213,159 A | | 5/1993 | Schneider | |
| 5,297,943 A | | 3/1994 | Martin | |
| 5,979,559 A | * | 11/1999 | Kennedy | 166/369 |
| 6,138,765 A | * | 10/2000 | Russell et al. | 166/387 |
| 6,179,585 B1 | | 1/2001 | Kobylinski et al. | |
| 6,206,093 B1 | * | 3/2001 | Lee et al. | 166/60 |

OTHER PUBLICATIONS

US Patent Application Publication US 2002/0066568, Buchanan et al., Jun. 2002.*

* cited by examiner

*Primary Examiner*—Zakiya Walker
(74) *Attorney, Agent, or Firm*—Robert Van Someren; Jeffrey Griffin; Brigitte Jeffery Echols

(57) ABSTRACT

An electric submersible pumping system having a downhole gauge section. The electric submersible pumping system comprises a submersible motor powered by a submersible pump. The submersible pump may be located below the submersible motor when in operation, while the downhole gauge section is disposed above the submersible motor. A power cable is coupled to the submersible motor through the downhole gauge section.

31 Claims, 3 Drawing Sheets

TECHNIQUE FOR SENSING FLOW RELATED PARAMETERS WHEN USING AN ELECTRIC SUBMERSIBLE PUMPING SYSTEM TO PRODUCE A DESIRED FLUID

FIELD OF THE INVENTION

The present invention relates generally to the production of fluids, such as hydrocarbon-based fluids, and particularly to a submersible pumping system that facilitates the monitoring of one or more fluid parameters.

BACKGROUND OF THE INVENTION

Pumping systems, such as electric submersible pumping systems, are utilized in pumping oil and/or other fluids from a variety of subterranean locations, including from producing wells. A typical submersible pumping system includes components such as a submersible motor, a motor protector and a submersible pump, e.g., a centrifugal pump.

During production of a given fluid, it may be desirable to sense one or more fluid parameters. When a submersible pumping system is utilized in a wellbore, for example, actual downhole, real-time measurements of parameters, such as temperature and pressure, may be beneficial in optimizing production and pump performance. Also, a diagnosis of pumping system problems and efficiency can be achieved quickly by monitoring the downhole parameters.

A variety of sensors/gauges may be utilized in combination with electric submersible pumping systems. However, some configurations of pumping systems render more difficult the sensing of certain parameters at desired locations. For example, in a bottom intake electric submersible pumping system, it is not practical to locate a gauge section beneath the system. However, if the gauge section is incorporated into the electric submersible pumping system between the submersible motor and submersible pump, it becomes necessary to design the gauge section for receipt of a drive shaft therethrough for powering the pump via the submersible motor. This can create added complexity and dependability problems. If, on the other hand, the gauge section is located above the submersible motor, there is increased difficulty in routing power conductors to the motor, particularly if the power cable is run through the coiled tubing or other deployment tubing.

SUMMARY OF THE INVENTION

The present invention features a technique for facilitating the measurement and monitoring of various fluid production parameters during the production of fluids, such as hydrocarbon-based fluids. The technique utilizes a gauge section incorporated with an electric submersible pumping system that permits power to be provided to the submersible motor through the gauge section.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
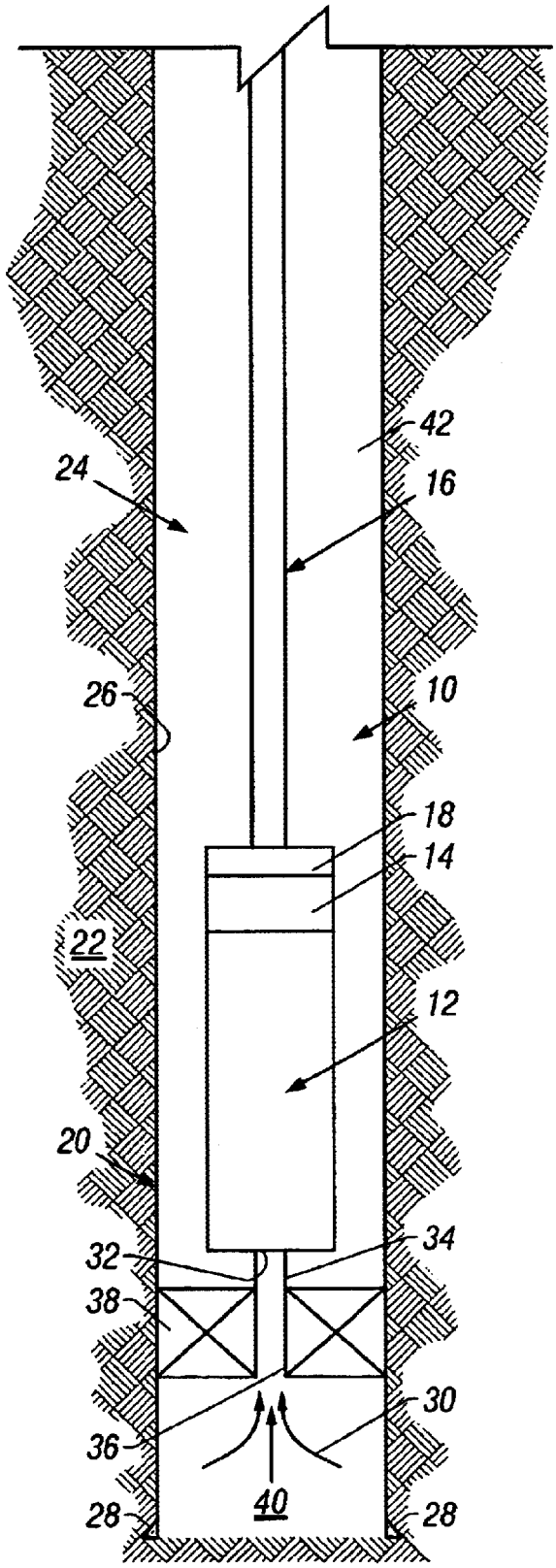
FIG. 1 is a schematic front elevational view of an exemplary electric submersible pumping system according to one embodiment of the present invention.

Referring generally to FIG. 1, a system 10, such as an electric submersible pumping system, is illustrated according to one exemplary embodiment of the present invention. System 10 may comprise a variety of components depending on the particular application or environment in which it is used. In this embodiment, system 10 comprises an electric submersible pumping system 12 having a gauge section 14 used in sensing one or more fluid parameters.

Electric submersible pumping system 12 is coupled to a deployment system, such as deployment tubing 16 by an appropriate connector 18. Deployment tubing 16 may comprise, for example, coiled tubing that facilitates the rapid deployment and removal of electric submersible pumping system 12 to and from its desired operational location. Deployment tubing 16 also may comprise jointed pipe or other tubing systems as are known to those of ordinary skill in the art.

In this particular example, pumping system 10 is deployed in a well 20 within a geological formation 22 containing desirable production fluids, such as petroleum. In a typical application, a wellbore 24 is drilled and lined with a wellbore casing 26. Wellbore casing 26 includes a plurality of openings 28, e.g. perforations, that permit one or more fluids 30 to flow into wellbore 24.

In the example illustrated, pumping system 12 is a bottom intake electric submersible pumping system having a bottom intake 32. Bottom intake 32 is coupled with a tube 34 that extends to or through an opening 36 disposed through a packer 38. Thus, fluids 30 are drawn from a region 40 beneath packer 38 and produced upwardly through an annulus 42 formed between deployment tubing 16 and wellbore casing 26. Typically, the fluids are produced to a collection location at, for example, the surface of the earth.

Figure 2:
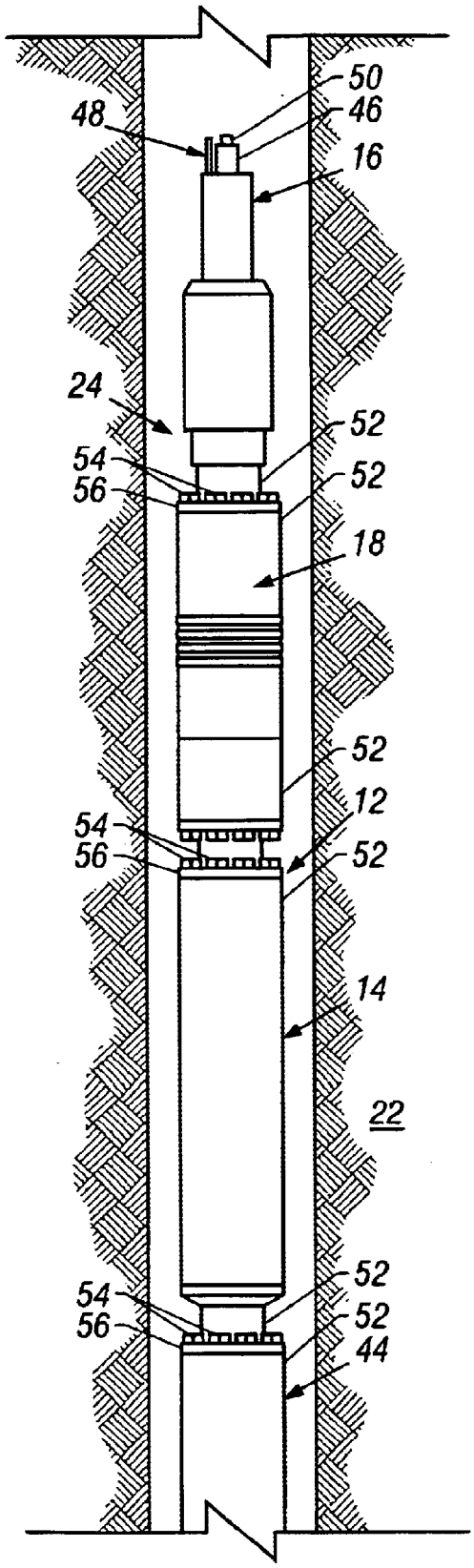
FIG. 2 is a front elevational view of a portion of an electric submersible pumping system such as the system illustrated in FIG. 1.

In a typical electric submersible pumping system 12, a submersible electric motor 44 is powered by electric current delivered by a power cable 46, as illustrated best in FIG. 2. In this embodiment, power cable 46 is deployed through a hollow interior passage 48 extending through deployment tubing 16, e.g. coiled tubing as illustrated best in FIG. 2. Power cable 46 typically comprises a plurality of power conductors 50 that are directed through lower connector 18 and gauge section 14 for connection with submersible motor 44. In the illustrated application, conductors 50 are not routed externally of coiled tubing 16, lower connector 18 or gauge section 14. In other applications, the power conductors 50 may be routed external to the deployment tubing 16 or electric submersible pumping system components. However, the internal routing provides protection and other advantages, at least in many applications.

The various components of electric submersible pumping system 12 may be made in a modular format that permits the substitution, addition, removal or servicing of individual components. In other words, each component typically includes a pair of mounting ends 52 designed for coupling to a variety of sequential components. In one embodiment, a plurality of fasteners, such as threaded bolts 54, are disposed through a flange 56 of one component and threaded into corresponding threaded bores of the next adjacent component, as known to those of ordinary skill in the art.

Figure 3A:
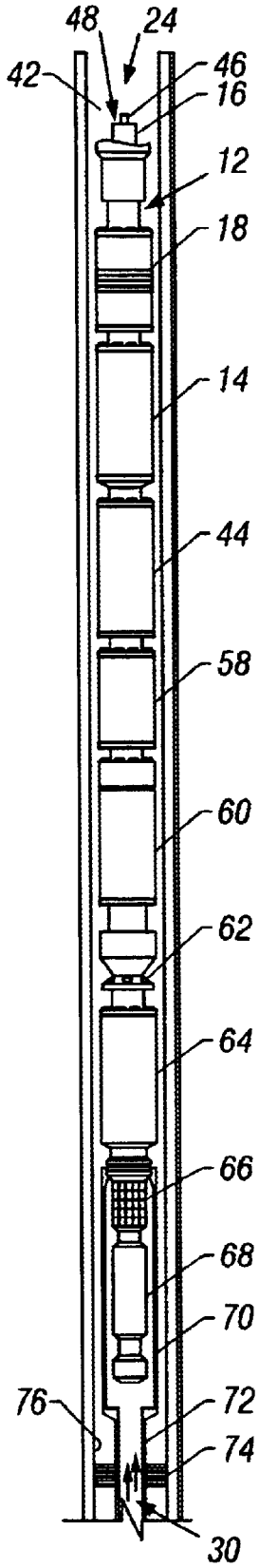
FIG. 3A is a front elevational view of an exemplary bottom intake submersible pumping system incorporating a gauge section, according to one embodiment of the present invention.

Although a variety of electric submersible pumping system configurations can be utilized, an exemplary bottom intake configuration is illustrated in detail in FIG. 3A. In this embodiment, electric submersible pumping system 12 is suspended within wellbore 24 by deployment tubing 16 having power cable 46 running through internal passage 48. Generally, lower connector 18 is connected to gauge section 14 which, in turn, is connected to submersible motor 44.

Submersible motor 44 is connected to a universal motor base 58 which is coupled to a motor protector 60. Motor protector 60 is connected to a pump discharge 62 of a submersible pump 64. Submersible pump 64 incorporates or is connected to a fluid intake 66 through which wellbore fluids 30 are drawn into submersible pump 64. Additionally, a variety of other components 68 may be attached to fluid intake 66 as would be known to those of ordinary skill in the art.

Submersible pump 64 is powered by submersible motor 44 via a plurality of shaft sections (not shown) disposed in each of the components deployed between the submersible motor 44 and submersible pump 64. By locating gauge section 14 uphole from submersible motor 44, e.g. above submersible motor 44 in this exemplary configuration, it is not necessary to employ a shaft section through gauge section 14. This provides added space and flexibility in the utilization of sensors within gauge section 14, as discussed more fully below. It should be noted that the system also can be used in lateral wellbores in which "uphole" should be construed as closer to the wellbore opening at the surface of geological formation 22.

In the embodiment illustrated in FIG. 3A, a shroud 70 is disposed about fluid intake 66. Shroud 70 extends downwardly and has a narrower flow section 72 deployed through an appropriate packer or seating shoe 74. A liner 76 is deployed externally about packer/seating shoe 74 and extends upwardly to form annulus 42 around electric submersible pumping system 12 and deployment tubing 16.

When electric submersible pumping system 12 is operated, fluid 30 is drawn upwardly through flow section 72, into the interior of shroud 70 and subsequently into fluid intake 66. This fluid is discharged into annulus 42 through pump discharge 62. Packer/seating shoe 74 prevents this fluid from returning to the region from which it was originally drawn, and the fluid accumulates within annulus 42, rising to the desired collection location. Thus, the discharged fluid is produced upwardly through annulus 42 and past gauge section 14, allowing the monitoring of discharged fluid parameters.

For example, gauge section 14 may be designed to sense discharge pressure, discharge temperature, and/or discharge flow. The monitoring of such parameters, particularly when monitored in real-time, facilitates optimization of production from the reservoir. If any problems or abnormalities arise, e.g. production problems or pump problems, they can be discovered quickly and corrective actions can be taken before other problems or failures are encountered.

Figure 3B:
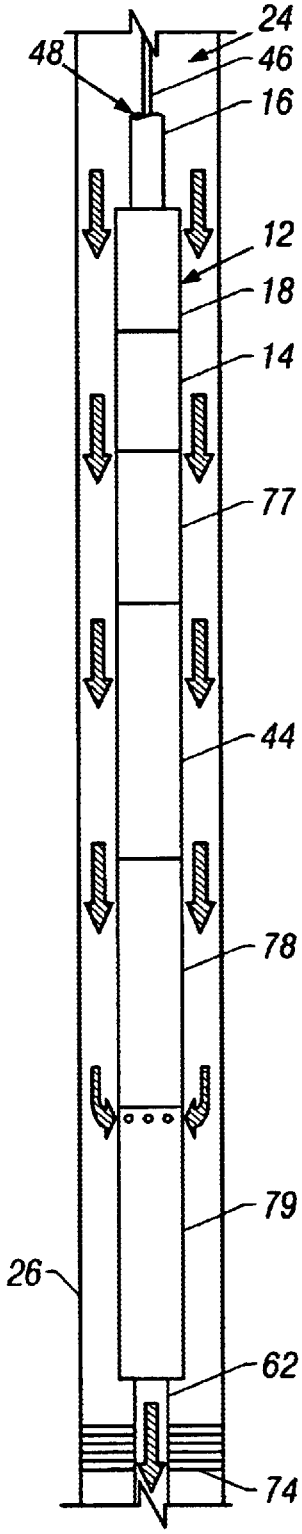
FIG. 3B is a front elevational view of a bottom discharge submersible pumping system incorporating a gauge section, according to another embodiment of the present invention.

An alternative embodiment of electric submersible pumping system 12 is illustrated in FIG. 3B. In this embodiment, electric submersible pumping system 12 comprises a bottom discharge configuration. As in the previous embodiment, electric submersible pumping system 12 is suspended within wellbore 24 by deployment tubing 16 having, for example, power cable 46 running through internal passage 48. Generally, lower connector 18 is connected to gauge section 14 which, in turn, is connected to an expansion chamber 77.

Expansion chamber 77 is connected to submersible motor 44, and submersible motor 44 is connected to a bottom discharge protector 78. Bottom discharge protector 78 is connected to the suction end of a bottom discharge submersible pump 79. Bottom discharge submersible pump 79 draws suction from the wellbore 24 above the packer/seating shoe 74. In this embodiment, the packer/seating shoe 74 is disposed between the pump discharge 62 and the wellbore casing 26. Bottom discharge submersible pump 79 discharges through pump discharge 62 beneath packer/seating shoe 74.

Bottom discharge submersible pump 79 is powered by submersible motor 44 via a plurality of shaft sections (not shown) disposed in each of the components deployed between the submersible motor 44 and bottom discharge submersible pump 79. By locating gauge section 14 uphole, e.g. above, submersible motor 44 as in the previous embodiment, it is not necessary to employ a shaft section through gauge section 14. This provides added space and flexibility in the utilization of sensors within gauge section 14, as discussed more fully below.

It should be noted again that the illustrated electric submersible pumping systems are exemplary embodiments, and a variety of other designs and configurations can be utilized depending on the particular application. For example, other components may be added or substituted. Certain components may be removed; the annulus may be defined by a liner or by the wellbore casing. Other instrumentation can be incorporated with the electric submersible pumping system or otherwise placed in the wellbore. Additionally, the electric submersible pumping system can be used in a variety of environments other than wellbore environments, such as in the movement of fluid stored in storage tanks or caverns. These are just some examples of other configurations and environments.

Figure 4:
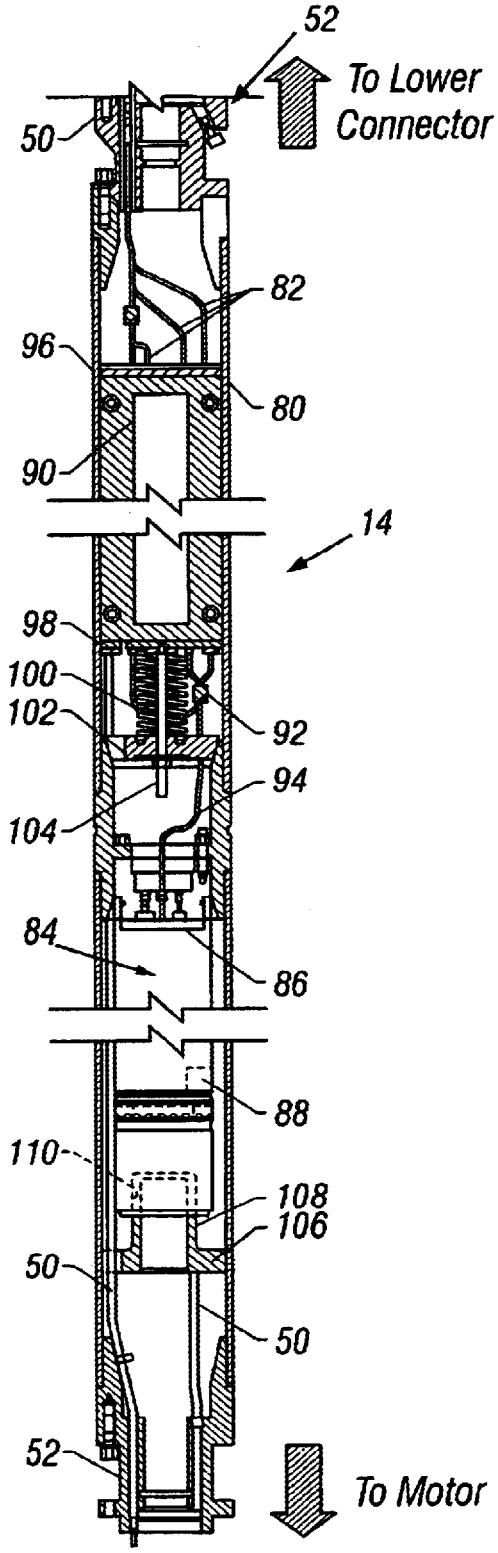
FIG. 4 is a cross-sectional view taken generally along the axis of an exemplary gauge section, such as that used in the electric submersible pumping system illustrated in FIG. 3.

Referring generally to FIG. 4, one embodiment of an exemplary gauge section 14 is illustrated. The exemplary gauge section 14 comprises an outer housing 80 extending between mounting ends 52. Power conductors 50 extend into outer housing 80 through, for example, upper mounting end 52. The power conductors 50 are routed through outer housing 80 for connection to submersible motor 44. However, appropriate leads 82 are spliced to or otherwise coupled to the power conductors 50 to provide power to a monitoring tool 84. Monitoring tool 84 may comprise one, two, three or more sensors. The sensors may include a variety of fluid sensors, equipment sensors or sensors for sensing other desired downhole parameters. Exemplary sensors 86 and 88 may comprise a pressure sensor, a temperature sensor, a vibration sensor, a flow sensor, and/or other pumping sensors configured to measure desired downhole parameters.

Leads 82 typically carry a relatively high voltage signal that must be reduced before being directed to monitoring tool 84. Accordingly, in a typical submersible system utilizing three phase power, the three leads 82 are coupled to a choke assembly 90. One exemplary choke assembly 90 reduces the voltage to a five-ten volt signal for operation of monitoring tool 84. Additionally, the three leads 82 are tied together at an artificial WYE point 92 beneath choke assembly 90. A single electrical lead 94 extends from the artificial WYE point 92 to monitoring tool 84, as illustrated in FIG. 4.

In this embodiment, choke assembly 90 is held within outer housing 80 by a snap ring 96 and a spring biased plate 98. The snap ring 96, for example, may be disposed above choke assembly 90, while plate 98 is disposed below. Plate 98 is biased upwardly by a spring 100, such as a coil spring. Spring 100 is trapped between plate 98 and a bulkhead 102 to provide an upward bias against choke assembly 90. Additionally, a stabilizing shaft 104 is attached to plate 98 and extends downwardly through spring 100 for slidable engagement through bulkhead 102.

A mounting structure 106 may be connected within outer housing 80 to provide structural support for monitoring tool 84. An exemplary mounting structure comprises a standoff having an upwardly extending portion 108 sized for receipt in a corresponding recess 110 formed within a lower portion of mounting tool 84.

It should be understood that the foregoing description is of exemplary embodiments of this invention, and that the invention is not limited to the specific forms shown. For example, a variety of sensors may be incorporated into the monitoring tool; the arrangement of components within the gauge section may be adjusted; the choke assembly may use a variety of windings or other features able to reduce voltage to a level acceptable for the monitoring tool; and the power conductors can be routed axially through each end of the gauge section or they can enter or exit laterally through an appropriate connector. These and other modifications may be made in the design and arrangement of the elements without departing from the scope of the invention as expressed in the appended claims.

What is claimed is:

1. A submersible pumping system for use in producing a fluid from a subterranean location, comprising:

a submersible motor;

a submersible pump located downhole of the submersible motor when in operation, the submersible pump being powered by the submersible motor;

a downhole gauge section disposed uphole of the submersible motor when in operation; and a power cable coupled to the submersible motor through the downhole gauge section.

2. The submersible pumping system as recited in claim 1, further comprising a deployment tubing supporting the power cable.

3. The submersible pumping system as recited in claim 2, wherein the power cable is deployed through an internal passage of the deployment tubing.

4. The submersible pumping system as recited in claim 3, wherein the downhole gauge section is coupled to the power cable to permit output of signals from the downhole gauge section through the power cable.

5. The submersible pumping system as recited in claim 3, further comprising a motor protector disposed between the submersible motor and the submersible pump.

6. The submersible pumping system as recited in claim 1, wherein the downhole gauge section is coupled to the power cable to permit output of signals from the downhole gauge section through the power cable.

7. The submersible pumping system as recited in claim 1, wherein the downhole gauge section is electrically coupled to the power cable via a y-point.

8. The submersible pumping system as recited in claim 1, wherein the downhole gauge section comprises a pressure sensor.

9. The submersible pumping system as recited in claim 8, wherein the downhole gauge section comprises a temperature sensor.

10. The submersible pumping system as recited in claim 8, wherein the pressure sensor senses an annular pressure of the submersible pump.

11. The submersible pumping system as recited in claim 1, wherein the downhole gauge section comprises a vibration sensor.

12. The submersible pumping system as recited in claim 1, wherein the downhole gauge section comprises a flow sensor.

13. A system for producing a fluid, comprising:

a bottom intake electric submersible pumping system having a submersible motor;

deployment tubing; and a downhole measuring tool disposed intermediate the submersible motor and the deployment tubing.

14. The system as recited in claim 13, further comprising a power cable coupled to the submersible motor through the downhole measuring tool.

15. The system as recited in claim 14, wherein the downhole measuring tool comprises a pressure sensor.

16. The system as recited in claim 15, wherein the downhole measuring tool comprises a temperature sensor.

17. The system as recited in claim 16, wherein the deployment tubing comprises a coiled tubing coupled to the bottom intake submersible pumping system.

18. The system as recited in claim 17, wherein the power cable is disposed through an internal passage of the coiled tubing.

19. The system as recited in claim 18, wherein the pumping system further comprises a submersible centrifugal pump powered by the submersible motor; a pump intake; and a pump discharge.

20. The system as recited in claim 19, wherein the pressure sensor senses an annular pressure of the submersible pump.

21. The system as recited in claim 14, wherein the downhole measuring tool comprises a temperature sensor.

22. A method for monitoring selected fluid parameters during production of a desired fluid with an electric submersible pumping system, comprising:

powering a submersible pump with a submersible motor located above the submersible pump;

sensing a desired pumping parameter from a gauge section disposed above the submersible motor; and providing electric power to the submersible motor and to the gauge section via a power cable.

23. The method as recited in claim 22, wherein providing comprises routing the power cable to the gauge section through an internal passageway of a deployment tubing.

24. The method as recited in claim 22, wherein providing comprises routing the power cable through an outer housing of the gauge section.

25. The method as recited in claim 24, further comprising drawing fluid into the submersible pump through a bottom intake.

26. The method as recited in claim 24, wherein sensing comprises sensing fluid pressure.

27. The method as recited in claim 26, wherein sensing comprises sensing fluid temperature.

28. The method as recited in claim 24, wherein sensing comprises sensing fluid temperature.

29. A system for monitoring selected fluid parameters during production of a desired fluid with an electric submersible pumping system, comprising:

means for powering a submersible pump with a submersible motor located above the submersible pump;

means for sensing a desired pumping parameter from a gauge section disposed above the submersible motor; and means for providing electric power to the submersible motor through the gauge section.

30. The system as recited in claim 29, further comprising means for drawing fluid into the submersible pump from a location below the submersible pump and the submersible motor.

31. The system as recited in claim 29, further comprising means for discharging fluid from the submersible pump at a location below the submersible pump and the submersible motor.

* * * * *